US007794415B2

(12) United States Patent
Hornsby et al.

(10) Patent No.: US 7,794,415 B2
(45) Date of Patent: Sep. 14, 2010

(54) SURFACE TREATMENT DEVICE

(75) Inventors: James Russell Hornsby, St. Louis, MO (US); Marcellus Rambo Benson, Chesterfield, MO (US); James Augustus Keefe, III, O'Fallon, MO (US); Joseph Lee McGowan, St. Charles, MO (US); Ashley B. Hornsby, Clayton, MO (US)

(73) Assignee: S.C. Johnson & Son, Inc., Racine, WI (US)

( * ) Notice: Subject to any disclaimer, the term of this patent is extended or adjusted under 35 U.S.C. 154(b) by 904 days.

(21) Appl. No.: 11/169,845

(22) Filed: Jun. 29, 2005

(65) Prior Publication Data

US 2006/0015043 A1 Jan. 19, 2006

Related U.S. Application Data

(60) Provisional application No. 60/587,358, filed on Jul. 13, 2004.

(51) Int. Cl.
*A61H 1/00* (2006.01)
*A47K 7/00* (2006.01)
*A47K 7/04* (2006.01)

(52) U.S. Cl. ..... 601/89; 601/15; 601/17; 601/84; 601/93; 601/97; 433/80; 401/134

(58) Field of Classification Search ..... 601/107, 601/88, 89, 112, 149, 15, 17, 72; 433/80; 401/132–135
See application file for complete search history.

(56) References Cited

U.S. PATENT DOCUMENTS 3,941,122 A 3/1976 Jones
4,299,004 A * 11/1981 Lancaster ..... 15/97.1
4,375,924 A * 3/1983 Lemire ..... 401/173
4,384,645 A * 5/1983 Manfredi ..... 206/229
4,818,134 A 4/1989 Tsai
5,123,841 A * 6/1992 Millner ..... 433/125
5,145,369 A 9/1992 Lustig et al.
5,208,933 A * 5/1993 Lustig et al. ..... 15/22.1
5,423,102 A 6/1995 Madison
5,471,102 A 11/1995 Becker et al.
5,647,851 A * 7/1997 Pokras ..... 604/131
5,649,334 A * 7/1997 Henriquez et al. ..... 15/29
5,651,157 A * 7/1997 Hahn ..... 15/22.1
5,700,146 A * 12/1997 Kucar ..... 433/82
5,794,303 A 8/1998 Sanfilippo et al.
5,881,418 A * 3/1999 Enoch ..... 15/101
5,927,851 A 7/1999 Carlson
6,010,263 A 1/2000 White et al.
6,062,229 A * 5/2000 Kandratavich et al. ..... 132/73.6
D437,663 S * 2/2001 Lang et al. ..... D28/68
6,203,320 B1 * 3/2001 Williams et al. ..... 433/80
6,220,772 B1 * 4/2001 Taylor ..... 401/176
6,292,971 B1 * 9/2001 Chaudray ..... 15/29

(Continued)

FOREIGN PATENT DOCUMENTS

FR 1063019 4/1954

(Continued)

*Primary Examiner*—Justine R Yu
*Assistant Examiner*—Clinton Ostrup

(57) ABSTRACT

A surface treatment device comprising a body, a motor disposed in the body, an applicator operably coupled to the motor, and a container coupled to the applicator via a fluid flow path, the container containing a surface treatment substance.

21 Claims, 6 Drawing Sheets

U.S. PATENT DOCUMENTS

| | | | | |
|---|---|---|---|---|
| 6,376,444 | B1 | 4/2002 | Hortel et al. | |
| 6,391,061 | B1 | 5/2002 | Hortel et al. | |
| 6,510,966 | B1 | 1/2003 | Perry et al. | |
| 6,656,541 | B1 | 12/2003 | Archer et al. | |
| 6,821,119 | B2 * | 11/2004 | Shortt et al. | 433/118 |
| 6,829,913 | B2 | 12/2004 | Goldoni et al. | |
| 6,905,276 | B2 | 6/2005 | Van Buskirk et al. | |
| 2002/0112741 | A1 * | 8/2002 | Pieroni et al. | 134/6 |
| 2002/0123703 | A1 | 9/2002 | Mark | |
| 2002/0175903 | A1 | 11/2002 | Fahracus et al. | |
| 2003/0120185 | A1 * | 6/2003 | Dirks et al. | 601/15 |
| 2003/0162145 | A1 * | 8/2003 | Masterman et al. | 433/118 |
| 2004/0071843 | A1 | 4/2004 | Zimmerman et al. | |
| 2004/0176737 | A1 | 9/2004 | Henley et al. | |

FOREIGN PATENT DOCUMENTS

| | | |
|---|---|---|
| JP | 64-20983 | 1/1989 |
| JP | 2-255191 | 10/1990 |
| JP | 11-59060 | 3/1999 |
| WO | WO 02/49497 | 6/2002 |
| WO | WO 02/093467 | 11/2002 |
| WO | WO 2004/073538 | 9/2004 |

* cited by examiner

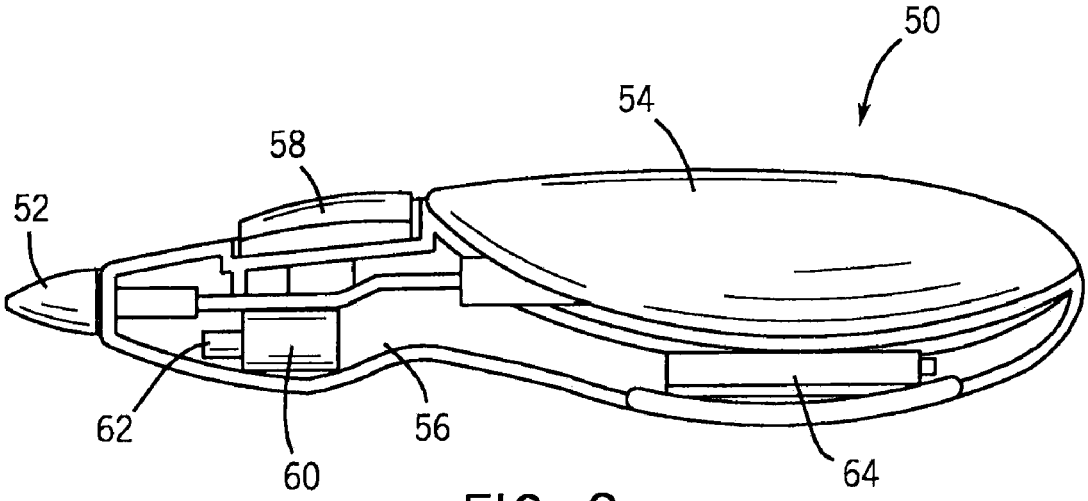
FIG. 2
FIG. 3A
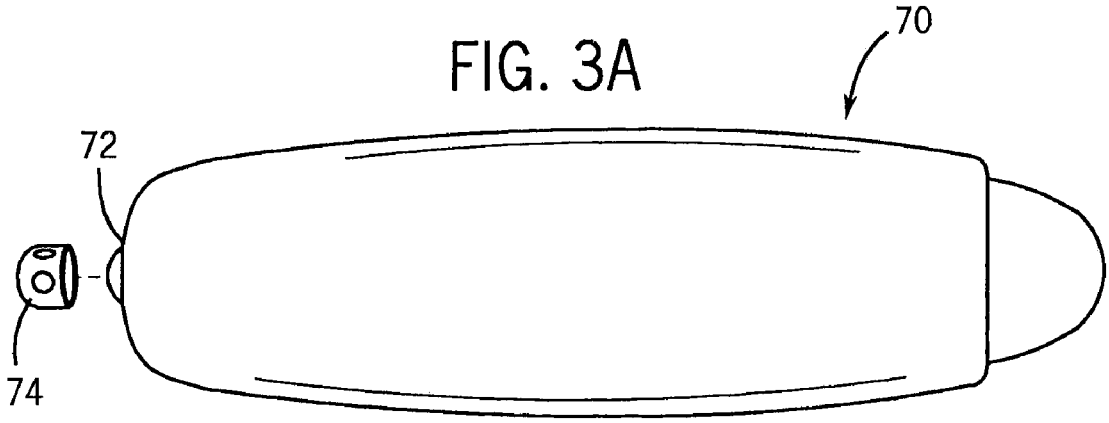
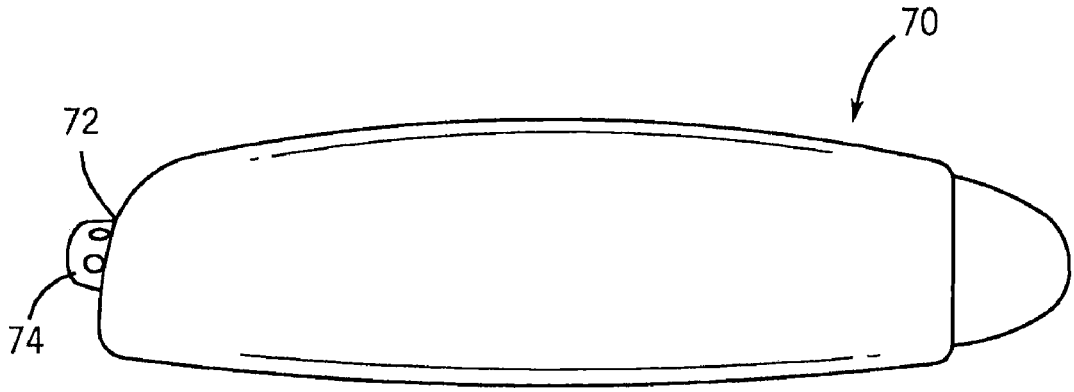
FIG. 3B

SURFACE TREATMENT DEVICE

CROSS-REFERENCE TO RELATED APPLICATION(S)

This application claims priority to U.S. Provisional Application No. 60/587,358, filed on Jul. 13, 2004, which is hereby incorporated herein by reference in its entirety.

BACKGROUND

The present invention relates to dispensing and/or surface treatment devices, including cleaning devices, devices for dispensing a substance useful for cleaning or sanitizing, and devices for dispensing or applying an active agent, and to devices for dispensing or applying an active agent and for acting on or treating a surface, either before application, during application or after the application. More particularly, in one embodiment, the invention relates to a small, portable, hand-held, generally pen-like dispenser or applicator for containing and dispensing a cleaning substance and for creating a vibratory contact with a surface. The vibration is an advantageous benefit associated with the present invention. It may provide enhanced dispersion, deeper penetration and/or enhanced efficiency of a cleaning agent or solution. It also may assist or be primarily responsible for breaking up dirt, coatings or layers of material to be removed from a surface.

SUMMARY

In one embodiment, the present invention comprises a surface treatment device comprising a body, a motor disposed in the body, an applicator operably coupled to the motor, and a container coupled to the applicator via a fluid flow path, the container containing a surface treatment substance. The invention encompasses a method of using the device to treat a surface and/or to apply the surface treatment substance and physically treat or act on the surface, too.

In one embodiment, the present invention comprises an application device comprising a body, a motor disposed within the body, an applicator tip carried by the body and operably coupled with the motor, and a container for containing a material capable of flowing, the container carried by the body and operably coupled to the applicator tip via a fluid flow-path.

In one embodiment, the present invention comprises an applicator and cleaning device comprising a body, a motor disposed within the body, an applicator tip carried by the body and operably coupled with the motor, and a container for containing a material capable of flowing, the container carried by the body and operably coupled to the applicator tip via a fluid flow-path, wherein when the applicator tip is brought into contact with a surface, the material will be applied to the surface, and, when the motor is actuated, the tip will move.

While multiple embodiments of the present invention are disclosed, still other embodiments will become apparent to those skilled in the art from the following detailed description, which shows and describes illustrative embodiments. As will be realized, the invention is capable of modification without departing from its spirit and scope. Accordingly, the drawings and detailed description are to be regarded as illustrative in nature and not restrictive.

BRIEF DESCRIPTION OF THE DRAWINGS

FIG. 2 is a side cross-sectional view of an application device, according to one embodiment of the present invention.

FIG. 3A is a top view of an application device, according to one embodiment of the present invention.

FIG. 3B is a top view of an application device, according to one embodiment of the present invention.

DETAILED DESCRIPTION

The present invention relates to a device having a replaceable cartridge containing an application material or active agent such as a cleaning material. The device may also include a powered applicator working end that can vibrate, spin, or otherwise provide motion that furthers the effectiveness of the device. Further, in some embodiments, the device may be a disposable item, i.e., the entire device may be thrown away or disposed of when emptied, it may be partially disposable and partially intended for re-use, or it may be wholly re-usable except for the replaceable cartridges.

Figure 1:
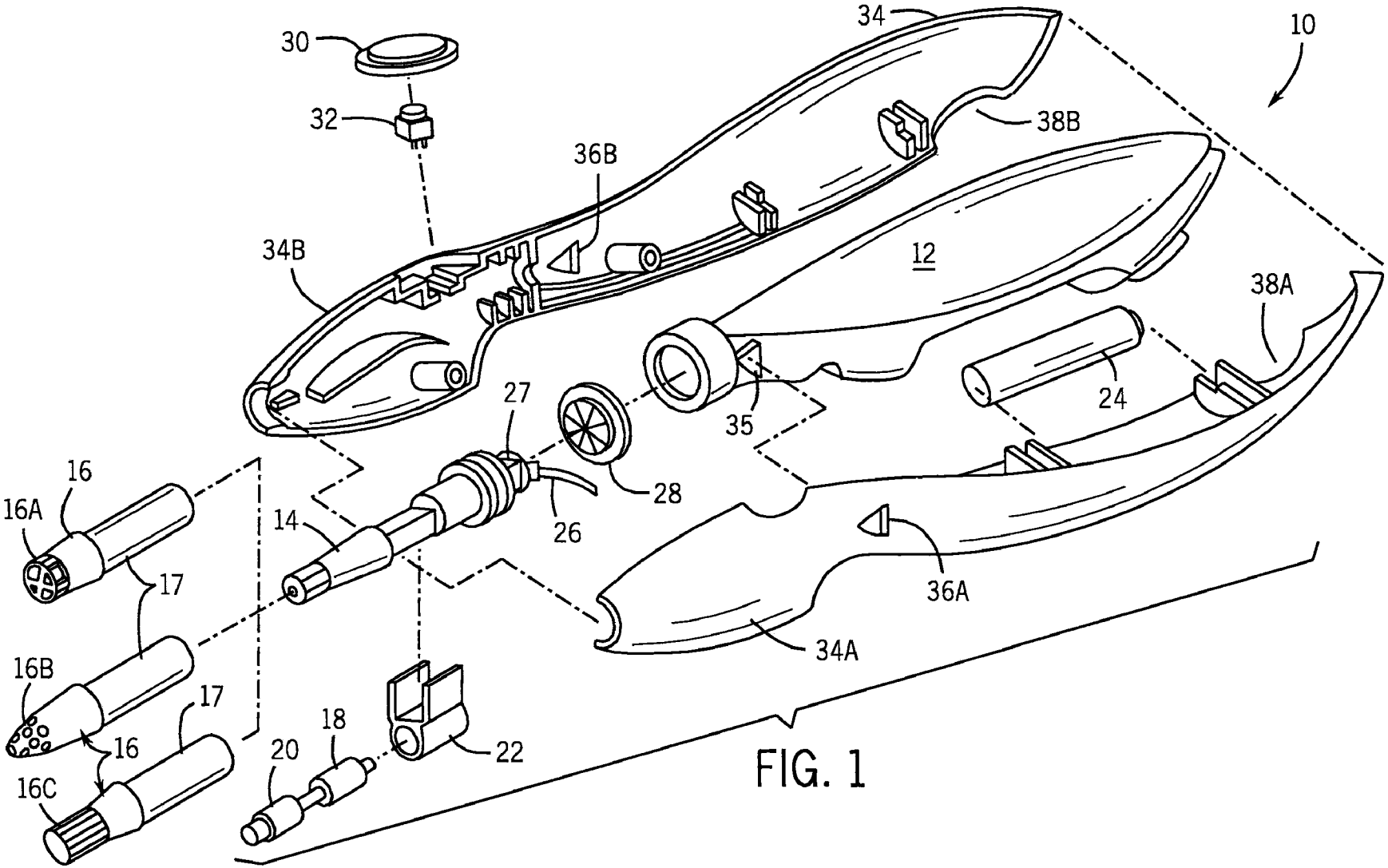
FIG. 1 is a perspective schematic view of an application device, according to one embodiment of the present invention.

FIG. 1 depicts a cleaning device 10, according to one embodiment of the present invention. The device 10 has an application component 16 operably connected to a container component 12 (also referred to herein as a "cartridge") through a transfer component 14. The application component 16 is powered by a motor 18. According to one embodiment, the motor 18 is connected to an offset weight component 20 that causes the application component 16A, 16B or 16C to vibrate. The motor 18 is housed in a motor housing component 22 that is connected to the transfer component 14 and is powered by a battery 24. The device has an actuation component 30 (also referred to herein as an actuation "button") operably connected with a suitable switch 32. The switch may be a momentary switch or it may be a typical off/on switch; in some embodiments, a suitable lock may be associated with the button 30 and/or the switch to lock the device in its off or on function. A housing component 34 having two housing segments 34A, 34B encases portions of the device 10. The housing component 34 has an opening 38A, 38B defined by the two segments 34A, 34B. The opening may be used to access the interior of the housing for any reason. For example, it may provide access to a power source, such as batteries, if it needs to be serviced or changed. Or, the opening and/or another generally similar opening could be adapted to permit the replacing of an emptied container of, for example, a cleaning agent.

In accordance with one aspect of the present invention, the application component 16 has a tube component 17 with a hollow portion (not shown) for operable connection with the transfer component 14.

Figure 1A:
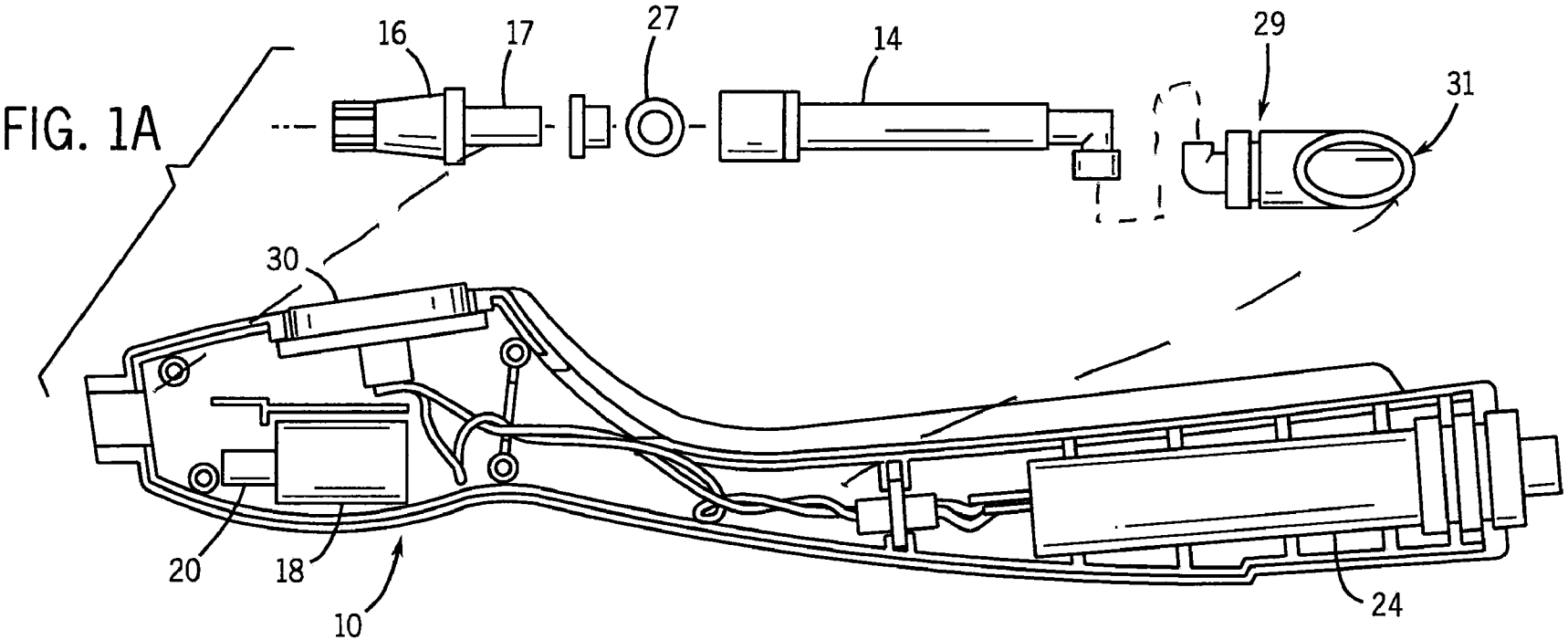
FIG. 1*a* depicts another embodiment of the application device of the present invention.

FIG. 1*a* depicts another embodiment of the present invention, wherein the device includes an insertion coupling 29. The coupling 29 is operably coupled to the transfer component 14 or other suitable structure operably linking the contents of the cartridge to the tip 16. In some embodiments, the coupling 29 extends through the handle of the device and includes a beveled edge 31 for penetrating the sealed opening of a cartridge. The edge 31 may be sharpened to aid in mounting a cartridge. When in place, a portion of a cartridge or the mounting structure associated with a cartridge extends over the coupling 29.

According to one embodiment, the transfer component 14 is operably coupled to the container component 12 via an insertion component 26 that is inserted through a membrane component 28 of the container component 12. The insertion component 26 includes a hollow portion therethrough (not visible) that is in fluid communication with at least one opening (not visible, but see FIGS. 1*b* and *c* at 19) in the application component tip 16A, 16B, or 16C.

Figure 1B:
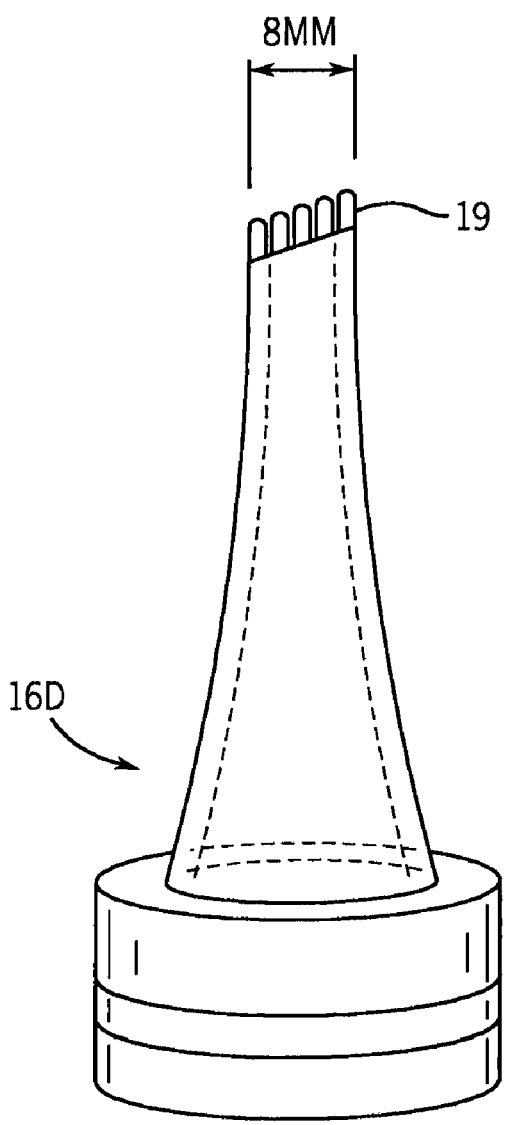
FIGS. 1*b* and *c* depict another embodiment of a tip for use with the present invention.
Figure 1C:
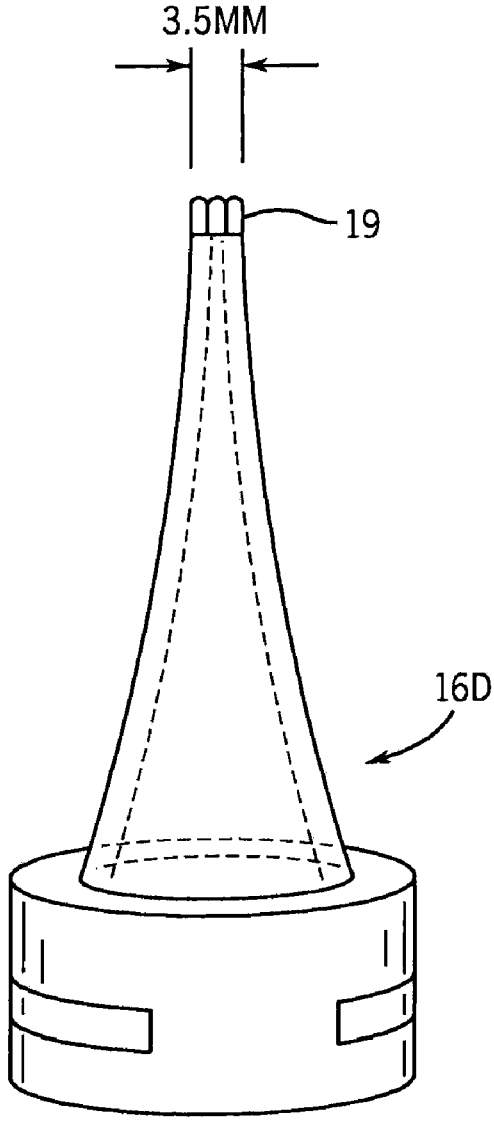

The application component 16, according to one embodiment, can have, for example, a scrubber tip 16A, a felt tip 16B, or a brush tip 16C. Another embodiment of a tip suitable for use with the present invention is depicted in FIGS. 1*b* and *c*, which show a tip 16D with a configuration and dimensions suitable for using on and/or in cracks, narrow spaces, crevices, etc. Also, the tip 16D, or another tip, may have another, different appropriate shape to be used for applying material in a spot or detailing manner. The application component 16 can have any tip with any composition or structure known to have cleaning and/or other surface treatment capabilities upon contact with a surface to be cleaned and/or otherwise treated. The tip 16A, 16B, or 16C, has at least one opening in fluid communication with the hollow portion of the tube component 17. In use, when material from the container component 12 passes through the transfer component 14 and into the application component 16, the material can pass out of the application component through the opening(s) in the tip 16A, 16B, 16C or 16D.

The motor housing component 22 operably connects the motor 18 to the application component 16. Alternatively, the motor 18 is housed and connected to the application component 16 by any known component in any known fashion.

According to one embodiment, the battery 24 is a standard AA battery. Alternatively, the battery 24 is any known power source suitable for a handheld device, including, for example, as to batteries, one or more standard AAA batteries, Nicad battery(ies) or button cell(s).

The container component 12 can contain any known cleaning material. For example, according to one embodiment, the cleaning material is a bleach solution. Alternatively, and without limitation, the cleaning material is a liquid, a gel, a foam, or any other known form of cleaning or other surface treatment material. Further, the cleaning material can be, but is not limited to, any commercial cleaning material or solution, including any cleaning material or solution appropriate for household, industrial, hospital, office or other types of cleaning. Other applications such as detailed application of a treatment agent are contemplated, as well. For example, an embodiment of the invention could be used to remove rust spots, apply a polishing-type compound, apply lotion to skin, etc.

The device 10, according to one alternative embodiment, can have a cover component (not shown) or "cap" that can operate to seal or "close" the device 10. In one embodiment, the cover component is placed over the application component 16.

FIG. 2 depicts a side view of a cleaning device 50, according to another embodiment of the present invention. The device 50 has an application component 52, a container component 54, a transfer component 56, an actuation component 58, a motor 60, an offset weight 62, and a power supply 64.

FIGS. 3A and 3B depict a top view of a cleaning device 70, according to yet another embodiment of the present invention. The device 70 has an application component 72 and a cover 74 configured to removeably cover the application component 72.

Figure 4A:
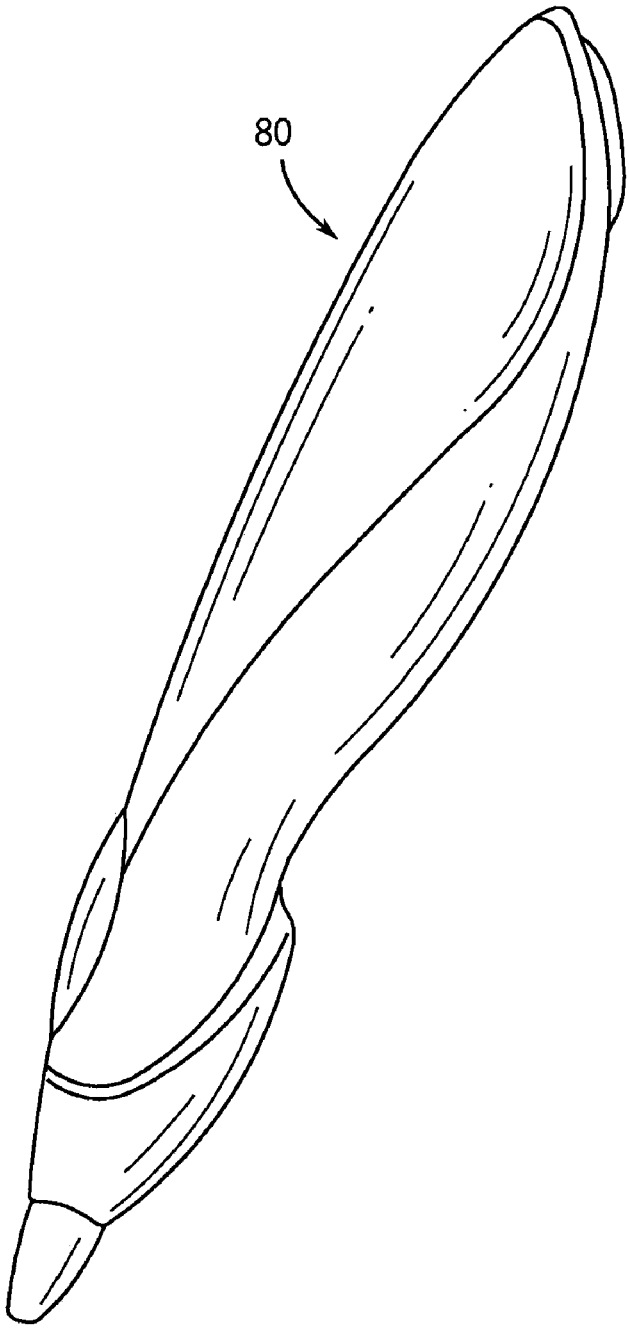
FIG. 4A is a perspective view of an application device, according to one embodiment of the present invention.
Figure 4B:
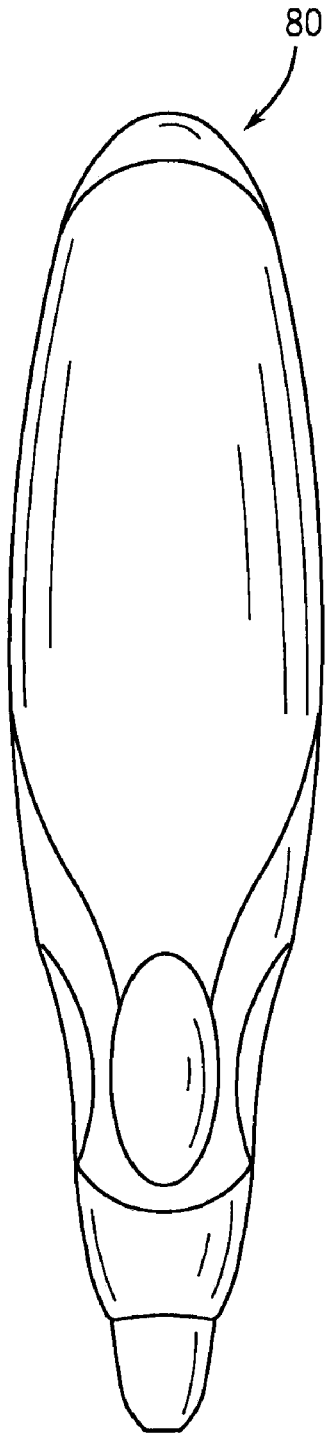
FIG. 4B is a top view of an application device, according to one embodiment of the present invention.

FIGS. 4A and 4B depict a cleaning device 80, according to a further embodiment of the present invention.

Figure 5:
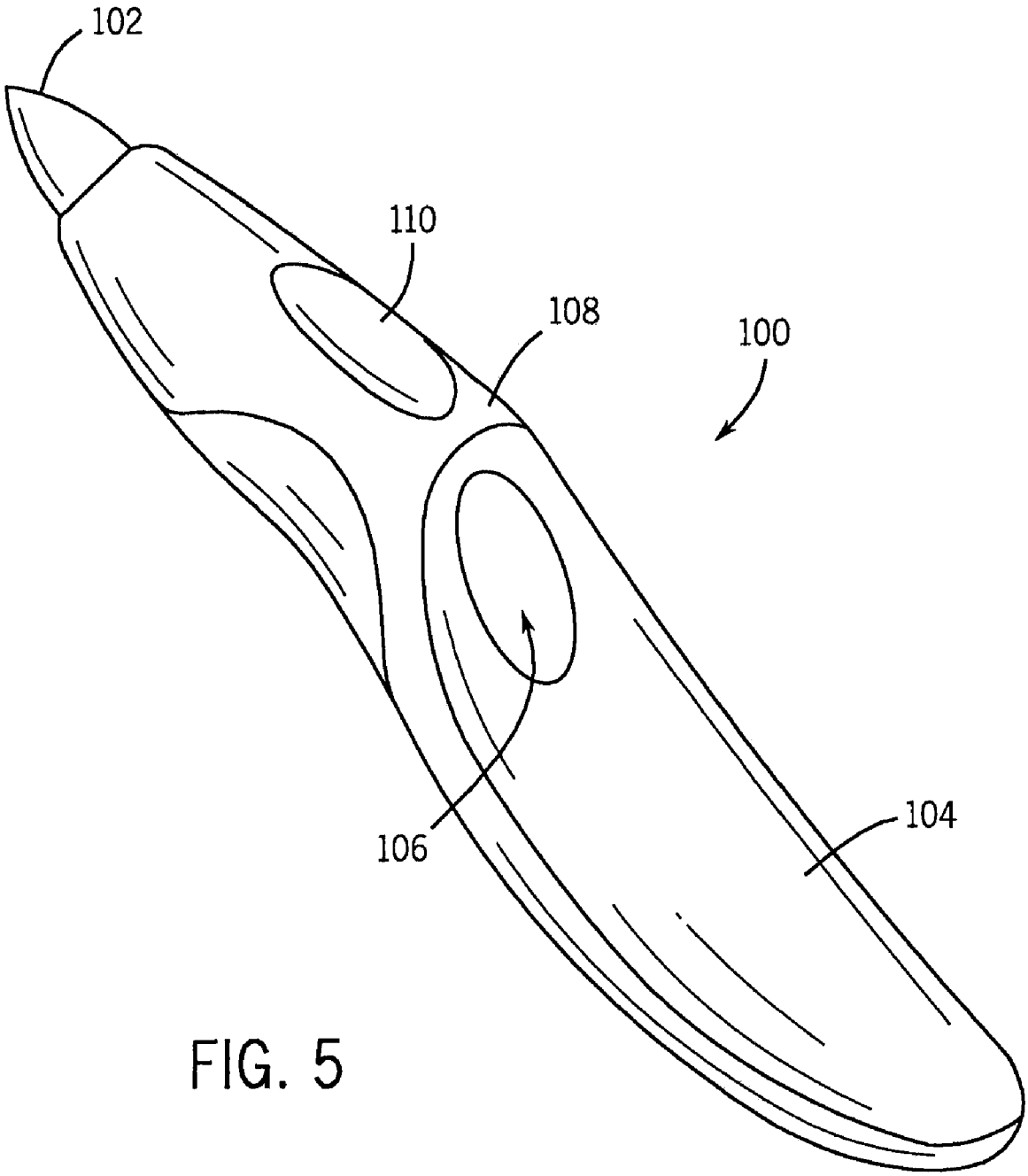
FIG. 5 is a perspective view of an application device, according to one embodiment of the present invention.

The cleaning device 100 shown in FIG. 5 is a cleaning device 100 capable of receiving a replaceable container component (not shown), according to another embodiment of the present invention. The device 100 in FIG. 5 has an application component 102, a container receiving area 104, a connection component 106 configured to connect with a container component (not shown), a housing component 108, and an actuation component 110. In such an embodiment, the container component is a removable, replaceable container component. That is, the container component can be positioned appropriately in the container receiving area 104, the device 100 can be operated until the cleaning material in the container component (not shown) is depleted, and the depleted container component can be removed and another container component containing material can be positioned in the container receiving area 104 for use. Alternatively, the entire device 100 is disposable after the material in the container (not shown) is depleted. In a further alternative, any portion of the device 100 can be configured to be re-usable, replaceable, or disposable. For example, the portion of the device 100 containing the actuation component 110 or the power source (not shown) may be non-disposable.

Returning to FIG. 1 for exemplary purposes, the device 10 in use according to one embodiment receives or already has received a container component 12. The container component 12 can be, in accordance with one aspect of the invention, positioned in the device 10 with the assistance of positioning components 35 on each side of the container component 12 (only one positioning component 35 is depicted). Each positioning component 35 is a raised portion or button or knob on the container component 12. When the container component 12 is positioned appropriately in the device 10, the positioning components 35 fit into positioning notches 36A, 36B in the housing component 34.

According to one embodiment, for example, the embodiment depicted in FIG. 1, as the container component 12 is positioned in the device 10 in preparation for use, the insertion component 26 pierces the membrane component 28 and is inserted into the container component 12 and a seal component 27 is thereby positioned in contact with the membrane component 28 to prevent any material in the container component 12 to leak. Other, generally similar seals, such as suitable gaskets, O-rings, etc., may be used as necessary. In some embodiments, for example, the embodiment depicted in FIG. 1*a*, the insertion coupling 29 may contact a suitable cartridge seal carried by a cartridge (not shown).

According to one embodiment, the device 10 can be actuated to perform three different operations. In one aspect of the invention, the device 10 can be actuated by depressing the actuation component 30, thereby causing material to be dispensed from the application tip 16A, 16B, or 16C onto a surface to be cleaned. Alternatively, the actuation component 30 is depressed to cause the motor to operate to create the vibration motion at the application component 16, which is then placed into contact with the surface to be cleaned, whereby the vibration action operates to help clean or otherwise treat the surface. In a further alternative, the actuation component 30 is depressed to cause both operations, such that material is dispensed from the application tip 16A, 16B, or 16C and the motor begins to operate, creating the vibration action at the application component 16, such that the application tip 16A, 16B, or 16C is then placed into contact with the surface to be cleaned and the material and vibrating action both operate in combination to help clean the surface. In a further alternative, two separate actuation components are provided, with one component dedicated to actuation of material dispensation and the other component dedicated to actuation of vibration. In some embodiments, the dispensing or application of the material may take place in the manner of what are known as "felt-tip" pens or markers. That is, the deposition or application of the material in the cartridge may be generally passive, occurring upon contact with the tip and a surface to be treated or occurring when the tip is pressed against the surface thereby compressing and/or deforming it. The device could then selectively be actuated to, for example, vibrate the tip, to assist in the even dispersion of the material.

When the device 10 is actuated to dispense the material contained in the container component 12 from the application component tip 16A, 16B, or 16C, the material, such as a cleaning fluid for example, is caused to pass from the container component 12 through the insertion component 26 and transfer component 14 and to exit the tip 16A, 16B, or 16C of the application component 16.

When the device 10 is actuated to vibrate, the motor is actuated to operate, thereby causing the offset weight 20 to spin. The spinning offset weight 20 causes the application component 16 to vibrate, which, according to one embodiment, furthers the cleaning action of the application tip 16A, 16B, or 16C. Alternatively, the vibrating action may be produced by means of a shaker plate, sonic piezoelectric harmonics or any other suitable means.

Any suitable coupling, connecting or linking methods and apparatus may be used in the present invention, and any suitable material may be used to form the invention. In some embodiments, the selected material(s) may depend on the substances to be dispensed. Further, any references to positions and/or locations are intended for convenience of description, not to limit the present invention to any one position or orientation.

With regard to means for fastening, mounting, attaching or connecting the components of the present invention to form the apparatus as a whole, unless specifically described as otherwise, such means are intended to encompass conventional fasteners such as screws, rivets, nuts and bolts, toggles, pins, threads, snap-fitting and the like. Other fastening or attachment means which may be appropriate for connecting components include adhesives, thermoforming, welding, friction fitting, etc.

Although the present invention has been described with reference to preferred embodiments, persons skilled in the art will recognize that changes may be made in form and detail without departing from the spirit and scope of the invention.

What is claimed is:

1. An application device, comprising:

(a) a substantially pen-shaped housing;

(b) a motor disposed within the housing and coupled to a motor housing component;

(c) a vibration application component having a tip and a generally elongated body extending from the housing, and a dispensing opening in the tip;

(d) a container coupled with the housing, the container configured to contain a flowable material, and (e) a transfer component connected to the vibration application component, the transfer component defining a fluid flow-path between the dispensing opening and the container, the transfer component being connected to the motor through the motor housing component, wherein the device further comprises an offset weight component coupled with the motor, wherein the axis of the offset weight component and the motor is not co-axial with the vibration application component, wherein actuation of the motor effects spinning of the offset weight component, causing the tip of the vibration application component to vibrate.

2. The device of claim 1 wherein the container is removable.

3. The device of claim 1 wherein the container is disposed within the housing.

4. The device of claim 1 wherein the motor, when actuated causes the vibration application component to vibrate at a high speed.

5. The device of claim 1 wherein the flowable material is a cleaning agent.

6. The device of claim 5 wherein the cleaning agent is a bleach solution.

7. The device of claim 5 wherein the cleaning agent is a commercially available cleaning solution.

8. The device of claim 5 wherein the cleaning agent is an antibacterial cleaning solution.

9. The device of claim 1 further comprising an actuator operably coupled with the motor.

10. The device of claim 1 further comprising a power source operably coupled with the motor.

11. The device of claim 1 wherein the vibration application component comprises a scrubber tip.

12. The device of claim 1 wherein the vibration application component comprises a felt tip.

13. The device of claim 1 wherein the vibration application component comprises a brush tip.

14. The device of claim 1 wherein the vibration application component comprises a crevice tip.

15. A handheld cleaning device, comprising:

(a) a handheld, substantially hollow housing;

(b) a vibration application component having a tip and a generally elongated body extending from the housing, and a dispensing opening in the tip;

(c) a replaceable cartridge containing a cleaning material, the housing configured to be capable of removeably receiving the replaceable cartridge;

(d) a transfer component connected to the vibration application component, the transfer component defining a fluid flow-path between the dispensing opening and the cartridge when the cartridge is received in the housing;

(e) a motor disposed within the housing, the motor being connected to the transfer component and an offset weight component, wherein actuation of the motor effects spinning of the offset weight component, causing the tip of the vibration application component to vibrate;

(f) a switch operably coupled with the motor; and (g) the switch is also operably coupled with the replaceable cartridge for dispensing the cleaning material from the replaceable cartridge through the transfer component and to the dispensing opening in the tip of the vibration application component.

16. The device of claim 15, wherein the device is disposable.

17. The device of claim 15, wherein the replaceable cartridge is disposable.

18. The device of claim 15, further comprising a removable cover configured to cover the vibration application component.

19. The device of claim 15, further comprising one or more positioning components coupled to the replaceable cartridge and one or more positioning notches provided in the housing, wherein when the replaceable cartridge is positioned appropriately in the device, the positioning components are received by the positioning notches.

20. A method of cleaning an object or surface, the method comprising:

providing a handheld cleaning device comprising:

(a) a substantially pen-shaped housing;

(b) a motor associated with the housing, the motor being coupled to an offset weight component and coupled to a motor housing component, wherein the motor effects spinning of the offset weight component causing the device to vibrate;

(c) a vibration application component having a tip and a generally elongated body extending from the housing, and a dispensing opening in the tip, wherein the axis of the offset weight component and the motor is not co-axial with the vibration application component;

(d) a removable container configured to contain a cleaning material configured to be dispensable through the dispensing opening; and (e) a transfer component connected to the vibration application component, the transfer component defining a fluid flow-path between the dispensing opening and the container, the transfer component being connected to the motor through the motor housing component;

actuating the device to dispense a portion of the cleaning material through the vibration application component and to cause the tip of the vibration application component to vibrate; and placing the vibration application component in contact with a surface to be cleaned and moving the vibration application component across the surface.

21. The method of claim 20, further comprising actuating the vibration application component to move.

* * * * *